United States Patent [19]

McKee

[11] Patent Number: 4,976,023

[45] Date of Patent: Dec. 11, 1990

[54] METHOD OF INSTALLING AND SIZING A BUSHING IN A SHAFT

[75] Inventor: Peter G. McKee, Franklin, Tenn.

[73] Assignee: Saturn Corporation, Troy, Mich.

[21] Appl. No.: 402,278

[22] Filed: Sep. 5, 1989

[51] Int. Cl.[5] ..... B21D 41/02; B23P 19/02

[52] U.S. Cl. ..... 29/523; 29/525

[58] Field of Search ..... 29/244, 252, 255, 263, 29/280, 282, 505, 506, 507, 516, 517, 522.1, 525, 523; 411/40, 41, 43, 55

[56] References Cited

U.S. PATENT DOCUMENTS

| | | | |
|---|---|---|---|
| 2,736,955 | 3/1956 | Fuglie | 29/280 X |
| 3,123,901 | 3/1964 | Traugott | 29/263 X |
| 3,534,988 | 10/1970 | Lindsey | 29/507 X |
| 4,006,923 | 2/1977 | Wagner | 29/507 X |
| 4,619,027 | 10/1986 | Ohannesian | 29/507 |

FOREIGN PATENT DOCUMENTS

| | | | |
|---|---|---|---|
| 413032 | 6/1974 | U.S.S.R. | 29/280 |

*Primary Examiner*—Mark Rosenbaum
*Assistant Examiner*—Peter Dungba Vo
*Attorney, Agent, or Firm*—Donald F. Scherer

[57] ABSTRACT

A bushing, disposed on an inner mandrel, is pressed into a deep drilled blind bore by an outer mandrel, to establish the longitudinal position of the bushing. The inner mandrel has a spherical end portion which is withdrawn through the bushing inner diameter to establish the desired finished diameter. After pressing the bushing into the bore, both inner and outer mandrels are removed. The shaft can then be installed in an apparatus, such as a transmission, and a fluid conducting tube can be readily supported in the bushing.

2 Claims, 1 Drawing Sheet

METHOD OF INSTALLING AND SIZING A BUSHING IN A SHAFT

BACKGROUND OF THE INVENTION

This invention relates to methods of installing bushings in a bore, and more particularly, to installing and sizing a bushing in a deep bore.

SUMMARY OF THE INVENTION

It is an object of this invention to provide an improved method of installing a bushing in a shaft and of sizing the inner diameter of the bushing after installation.

It is another object of this invention to provide an improved method of installing a bushing in a bore and sizing the inner diameter of the bushing, wherein the bushing is mounted on an inner mandrel of concentric mandrels, pressed into the bore by the outer mandrel and sized by withdrawal of a spherical surface secured to the distal end of the inner mandrel.

It is a further object of this invention to provide an improved shaft and bushing assembly, wherein the shaft is bored to form a longitudinal passage and transversely drilled at two locations intersecting the longitudinal passage, and further wherein the bushing is mounted on an inner one of concentric mandrels and pressed into the bore by an outer mandrel to a position between the transversely drilled passages, and also wherein the inner mandrel is withdrawn through the bushing to size the inner diameter of the bushing.

These and other objects and advantages of the present invention will be more readily apparent from the following description and drawings.

DESCRIPTION OF THE PREFERRED EMBODIMENT

Figure 1:
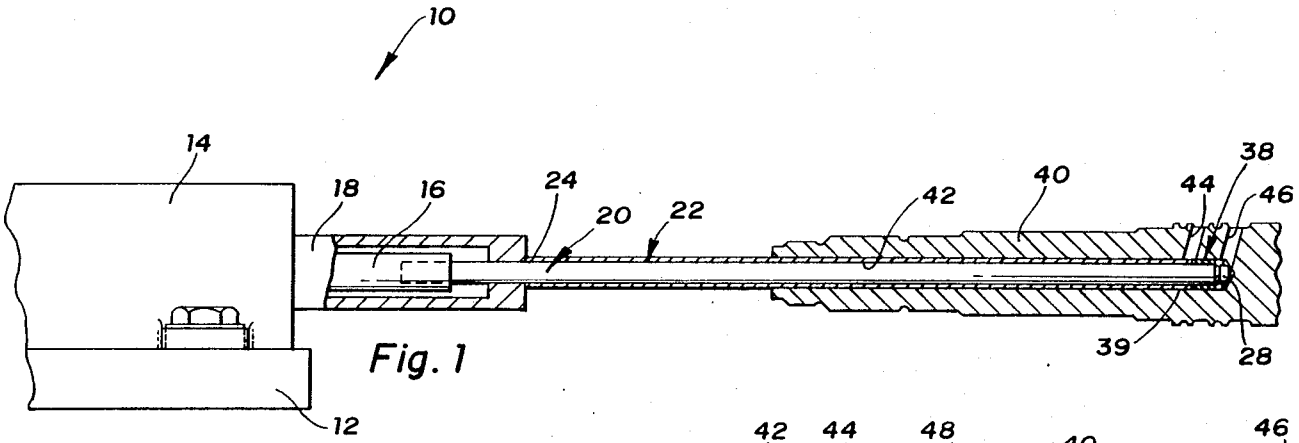
FIG. 1 is an elevational view, partly in section, of a shaft and bushing installation apparatus.

Referring to the drawings, wherein like characters represent the same or corresponding parts throughout the several views, there is seen in FIG. 1, an installation apparatus, generally designated 10, and consisting of a base member 12, a hydraulic cylinder 14 and an output rod 16 having a piston end, not shown, disposed within the cylinder 14. As is well known, fluid pressure is admitted to the cylinder 14 to cause the rod 16 to move longitudinally. The cylinder 14 has an extension 18 which surrounds a portion of the rod 16.

The rod 16 has secured therewith an inner mandrel 20. The inner mandrel 20 is disposed within an outer mandrel 22, which has an end portion 24 disposed in abutment with the extension 18. The right end of the inner mandrel 20 has a threaded opening 25 adapted to receive a fastener 26. The fastener 26 has operatively connected therewith, a spherical section 28 which has an outer diameter 30 slightly larger than the outer diameter 32 of the inner mandrel 20.

Figure 2:
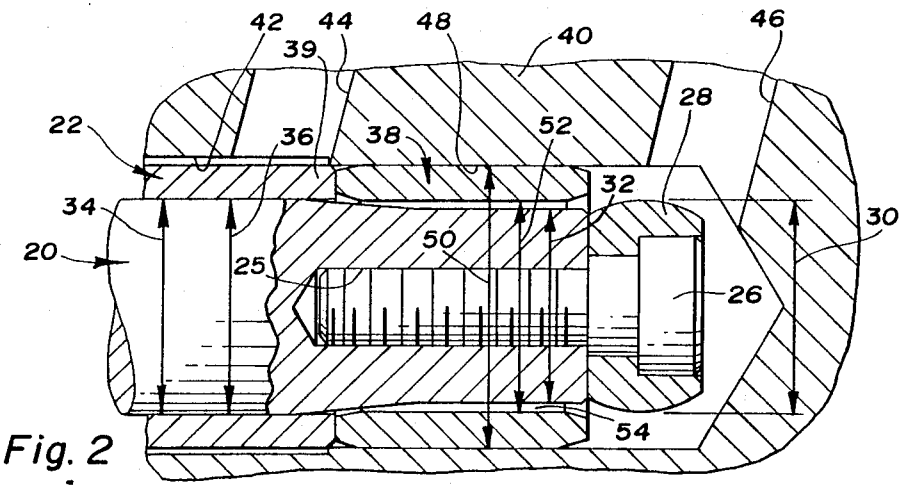
FIG. 2 is a sectional view of an enlarged portion of FIG. 1.

As best seen in FIG. 2, the diameter 32 of inner mandrel 20 extends for a short distance along the mandrel 20, after which the outer surface is enlarged to a diameter 34. The diameter 34 is dimensioned to be slidably disposed within an inner diameter 36 of the outer mandrel 22.

An annular bushing 38 is disposed on the end of inner mandrel 20 circumjacent the diameter 32. After disposition of the bushing 38, the fastener 26 and spherical section 28 are secured to the mandrel 20. As seen in FIG. 2, the bushing 38 is disposed in abutment with the end 39 of outer mandrel 22. With the bushing thus assembled on the mandrels 20 and 22, a shaft member 40, having a longitudinal bore 42 can be assembled over the bushing 38. The assembly of the bushing 38 into the bore 42 can be accomplished by moving the mandrels 20 and 22 rightward, while holding the shaft 40 stationary, or holding the mandrels 20 and 22 stationary, while moving the shaft 40 leftward.

The bore 42 is intersected by a pair of transversely drilled passages 44 and 46. The diameter of a portion 48 of the bore 42 between the passages 44 and 46, is preferably slightly reduced from the diameter of the bore 42 viewed leftward of the passage 44. The portion 48 has a diameter which is less than the outer diameter 50 of the bushing 38 before installation, such that the bushing 38 will undergo slight deformation when pressed into the portion 48 of bore 42. The diameter 32 of mandrel 20 cooperates with the inner diameter 52 of the bushing 38 to establish a clearance 54. This clearance permits the inner diameter 52 of bushing 38 to decrease in size during the pressing operation.

After the bushing has been installed between the passages 44 and 46, the position of the bushing is maintained by the outer mandrel 22 while the inner mandrel 20 is withdrawn leftwardly, such that the spherical section 28 must pass through the inner diameter 52 of the bushing 38. The diameter 30 of the spherical section 28 is of a value equal to the desired finished diameter of the inner diameter 52. As the spherical section 28 passes through the bushing 38, the bushing 38 will be pressed outward into the bore 42 an increase in length slightly. The bushing material, which flows outward into machining marks in the bore 42, will create a mechanical interlock therewith such that the bushing 38 will not be easily removable.

The shaft 40 is separated from the mandrel assembly after the spherical section 28 has passed through the bushing 38. The shaft and bushing may then be utilized in a power transmitting apparatus, such as a multi-ratio transmission. In at least one such device, the bushing is found to be useful as a rotating surface for a tubular member, not shown, which is disposed to transmit fluid from the left end of shaft 40 to the passage 46, while the space between the outer surface of the tube and bore 42 is utilized as a passage to transmit fluid from the left end of shaft 40 to the passage 44. With this arrangement, the tube can be secured in a transmission housing and remain stationary relative to the shaft 40 while the bushing 48 provides a sealing and rotating interface.

The bushing 38 is preferably made from sintered metal comprised of approximately 58.5% iron, 36.25% copper, 4% tin and 1.25% graphite. With this composition, the bushings 38 can be installed with an interference fit into a steel shaft. This material will permit the interference fit to be approximately twice the interference fit used with the traditional bearing materials. The increased interference fit allows additional tolerance for a gun drilling or gun reaming operation used to form the bore 42 in the shaft 40, thus reducing production costs of the shaft.

This method of installation and sizing has been utilized in test procedures wherein a plurality of bushings having various interference fits were press fit into a blind bored shaft. After pressing, the spherical segment 28 was withdrawn and the final size of diameter 52 was measured, it was found that this process resulted in the inner diameter of bushing 38 being maintained with a range of less than 50% of the tolerance designated on the assembly print.

With this reduced tolerance spread, improved sealing is obtained between the bushing 38 and the fluid conducting tube which will be inserted within the shaft during assembly of the apparatus in which the shaft is used.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. A method of installing and sizing a bushing, to a desired longitudinal position and a desired finish diameter in a deep drill blind passage comprising:

inserting a bushing on an inner mandrel having one end formed with a segmented spheroidal surface of a diameter equal to the desired finished diameter of the bushing and a shaft portion having a diameter accommodating the bushing inner diameter prior to finishing;

installing an outer mandrel over the inner mandrel, said outer mandrel having an outer diameter less than the diameter of the drilled blind passage and an inner diameter not less than the desired finished diameter of the bushing;

pressing the bushing into the drilled blind passage by exerting an axial force on the outer mandrel until the bushing is in the desired longitudinal position in the shaft;

maintaining the outer mandrel in the position establishing the desired longitudinal position;

withdrawing the inner mandrel to force the spheroidal end of the inner mandrel through the bushing to size the inner diameter of the bushing to the desired finished diameter; and removing both mandrels from the drilled blind passage after the spheroidal end of the inner mandrel has exited from the bushing.

2. A method of installing and sizing a bushing, to a desired longitudinal position and a desired finish diameter in a deep drilled longitudinal passage which is intersected at two locations by transverse passages comprising:

inserting a bushing on an inner mandrel having one end formed with a segmented spheroidal surface of a diameter equal to the desired finished diameter of the bushing and a shaft portion having a diameter accommodating the bushing inner diameter prior to finishing;

installing an outer mandrel over the inner mandrel, said outer mandrel having an outer diameter less than the diameter of the drilled passage and an inner diameter not less than the desired finished diameter of the bushing;

pressing the bushing into the drilled passage by exerting an axial force on the outer mandrel until the bushing is in the longitudinal passage at a position substantially between the transverse passages;

maintaining the outer mandrel in the position establishing the position in the longitudinal passage;

withdrawing the inner mandrel to force the spheroidal end of the inner mandrel through the bushing to size the inner diameter of the bushing to the desired finished diameter; and removing both mandrels from the drilled longitudinal passage after the spheroidal end of the inner mandrel has exited from the bushing.

* * * * *